US008132905B2

(12) United States Patent
Yamamoto

(10) Patent No.: US 8,132,905 B2
(45) Date of Patent: Mar. 13, 2012

(54) RECORDING DEVICE HAVING A CONVEYING UNIT THAT CONVEYS A RECORDING MEDIUM

(75) Inventor: Shinya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 671 days.

(21) Appl. No.: 12/326,083

(22) Filed: Dec. 1, 2008

(65) Prior Publication Data

US 2009/0141111 A1 Jun. 4, 2009

(30) Foreign Application Priority Data

Nov. 30, 2007 (JP) ..... 2007-309893

(51) Int. Cl.
*B41J 2/01* (2006.01)
*B41J 29/13* (2006.01)

(52) U.S. Cl. ..... 347/104; 347/108

(58) Field of Classification Search ..... 347/104, 347/108, 214, 222
See application file for complete search history.

(56) References Cited

U.S. PATENT DOCUMENTS 4,873,541 A * 10/1989 Hirose et al. ..... 347/118
5,274,399 A * 12/1993 Uchida et al. ..... 346/134
5,921,687 A * 7/1999 Koike et al. ..... 400/120.01
5,975,515 A * 11/1999 Capri et al. ..... 271/9.11
6,647,228 B2 * 11/2003 Nakamura et al. ..... 399/124
8,025,392 B2 * 9/2011 Yamamoto ..... 347/104
2005/0212883 A1 9/2005 Okamoto
2006/0210306 A1 * 9/2006 Okamoto ..... 399/119

FOREIGN PATENT DOCUMENTS

JP S57-156935 A 9/1982
JP 01321220 A * 12/1989
JP 2000-198571 A 7/2000
JP 2002-182482 A 6/2002
JP 2005-271278 A 10/2005
JP 2007-269498 A 10/2007

OTHER PUBLICATIONS

Japan Patent Office, Notice of Reasons for Rejection for Japanese Patent Application No. 2007-309893 (counterpart to above-captioned patent application), mailed Oct. 11, 2011.

* cited by examiner

*Primary Examiner* — Daniel Petkovsek
(74) *Attorney, Agent, or Firm* — Baker Botts L.L.P.

(57) ABSTRACT

The invention relates to a recording device that includes a casing and a conveying unit that conveys a recording medium, and the conveying unit is positioned in the casing. The recording device also includes a recording unit that performs recording on the recording medium that is being conveyed by the conveying unit, and the recording unit opposing the conveying unit in the casing. The recording device may also include a cassette that is removably mountable to the casing and that is positioned in an area adjacent to the conveying unit when the cassette is mounted to the casing. The recording device may also include a movement mechanism that moves a portion of the conveying unit to the area adjacent to the conveying unit when a portion of the cassette is removed from the casing.

15 Claims, 4 Drawing Sheets

RECORDING DEVICE HAVING A CONVEYING UNIT THAT CONVEYS A RECORDING MEDIUM

CROSS REFERENCE TO RELATED APPLICATION

This application claims priority to and the benefit of Japanese Patent Application No. 2007-309893, filed Nov. 30, 2007, the entire subject matter and disclosure of which are incorporated herein by reference.

BACKGROUND OF THE INVENTION

1. Field of the Invention

The invention relates to a recording device comprising a conveying unit that conveys a recording medium.

2. Description of the Related Art

A known recording device conveys paper as a recording medium and ejects ink from a number of nozzles onto the paper to record images. In the recording device, paper is taken out during paper jamming treating by moving the conveying unit including a belt and the like in a direction that separates the conveying unit from heads.

Inside a casing of the recording device, heads, a conveying unit, and a paper feed cassette are arranged in this order from above. Between the conveying unit and the paper feed cassette, there is provided a space for moving the conveying unit during paper jamming treating. This makes it difficult to achieve size-reduction of the casing, and hence, of the recording device.

SUMMARY OF THE INVENTION

A need has arisen for a recording device allowing an achievement of size-reduction of the device.

According to an embodiment of the invention, a recording device may comprise a casing, and a conveying unit that is configured to convey a recording medium, wherein the conveying unit is positioned in the casing. The recording device may also comprise a recording unit that is configured to perform recording on the recording medium that is being conveyed by the conveying unit, wherein the recording unit opposes the conveying unit in the casing. The recording device may also comprise a cassette that is removably mountable to the casing and that is positioned in a area adjacent to the conveying unit when the cassette is mounted to the casing. The recording device may also comprise a movement mechanism that is configured to move at least one portion of the conveying unit to the area adjacent to the conveying unit when at least a portion of the cassette is removed from the casing.

According to another embodiment of the invention, a recording device may comprise a casing, and a conveying unit that is configured to convey a recording medium, wherein the conveying unit is positioned in the casing. The recording device may also comprise a recording unit that is configured to perform recording on the recording medium that is being conveyed by the conveying unit, the recording unit opposing the conveying unit in the casing. The recording device may also comprise a cassette that is configured to move between a first position and a second position, wherein when the cassette is in the first position, the cassette is mounted to the casing, and when the cassette is in the second position, at least a portion of the cassette is removed from the casing. The recording device may also comprise a movement mechanism that is configured to move at least one portion of the conveying unit to the first position when the cassette is in the second position.

Other objects, features and advantages will be apparent to those skilled in the art from the following detailed description and accompanying drawings.

BRIEF DESCRIPTION OF THE DRAWINGS

For a more complete understanding of the invention, and the needs satisfied thereby, reference now is made to the following descriptions taken in connection with the accompanying drawings.

DESCRIPTION OF THE EMBODIMENTS

The embodiments of the invention, and their features and advantages, may be understood by referring to FIGS. 1-4, like numerals being used for corresponding parts in the various drawings.

Figure 1:
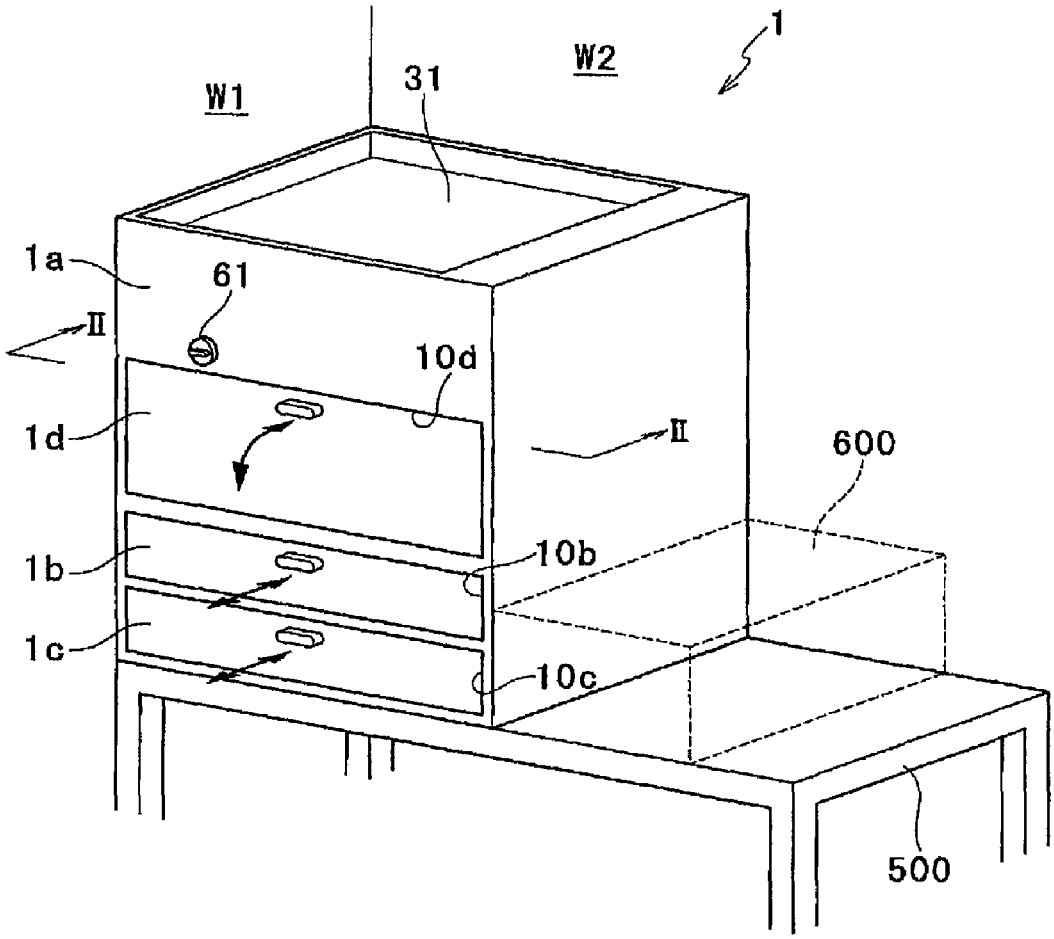
FIG. 1 is a perspective view showing an ink jet printer according to an embodiment.

Referring to FIG. 1, the ink jet printer 1 may comprise a casing 1*a* having a rectangular parallelepiped shape. The ink jet printer may also comprise a turning member 61, an opening 10*d*, an opening 10*b*, and an opening 10*c*, which are positioned in the above order, e.g. descending order, from the top, on the front side of the ink jet printer 1. The turning member 61 may be turned by an operation of the user. The door 1*d* may be positioned in the front side of the casing 1*a*. The door 1*d* may be fixed to the opening 10*d* and may be opened and closed with a horizontal axis on a bottom edge as a fulcrum. A paper feed cassette 1*b* may be inserted into the openings 10*b*. An ink tank cassette 1*c* may be inserted into the openings 10*c*. A paper discharge portion 31 may be positioned on the top surface of the ink jet printer 1*a*. The door 1*d* may oppose a conveying unit 21 in a depth direction of the casing 1*a*. More specifically, referring to FIG. 2, the door 1*d* may oppose a conveying belt 8 of the conveying unit 21, in the direction parallel with the outer peripheral surface of the conveying belt 8 and perpendicular to the conveying direction, i.e., in the direction perpendicular to the plane of FIG. 2. The ink jet printer 1 may be placed on a table 500 such that a left side surface and a back surface thereof make contact with walls W1 and W2, respectively. There may be a space on a right side surface of the ink jet printer 1, capable of accommodating another object 600.

Figure 2:
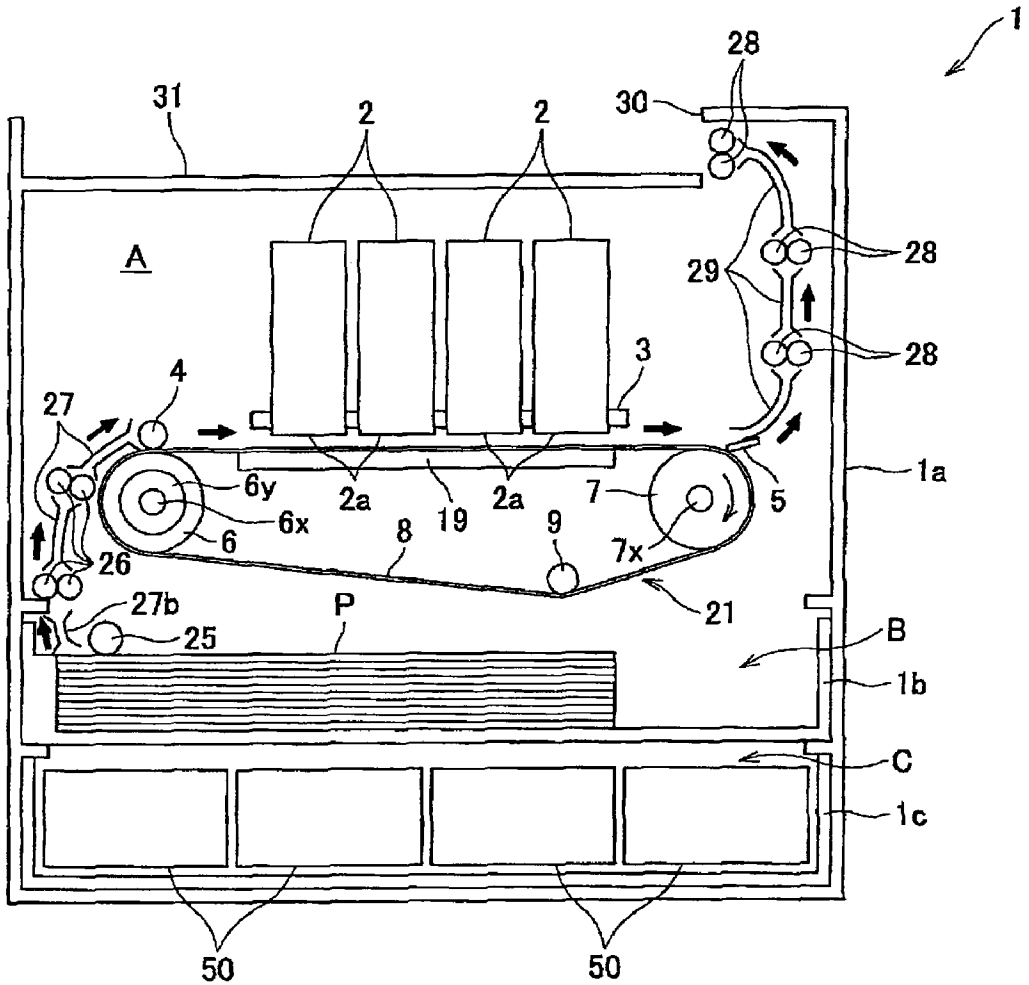
FIG. 2 is a sectional side view of the ink jet printer taken along a line II-II in FIG. 1.

Referring to FIG. 2, the inside of the casing 1*a* of the ink jet printer 1 may be sectioned into a plurality of, e.g., three, areas A, B, and C in this order from above. The area A may comprise a plurality of, e.g., four, ink jet heads 2 ejecting magenta, cyan, yellow, and black; and a conveying unit 21. The areas B and C, respectively, may be areas for use in mounting the paper feed cassette 1*b* and the ink tank cassette 1*c*. The paper feed cassette 1*b* and the ink tank cassette 1*c* may be removably mounted into the casing 1*a*, respectively. The areas B and C may be communicated with openings 10*b* and 10*c*, respectively. The mounting and demounting of the paper feed cassette 1*b* and the ink tank cassette 1*c* into and from the casing 1*a* may be performed along the direction perpendicular to the plane of FIG. 2.

A paper conveying path, through which paper P serving as a recording medium, may be positioned inside the ink jet printer 1. The paper conveying path may convey paper P along thick arrows shown in FIG. 2 from the paper feed cassette 1*b* up to the paper discharge portion 31. A plurality of sheets of paper P may be stacked in the paper feed cassette 1*b*. The paper P lying in an uppermost position may be picked up from the paper feed cassette 1*b* by a pickup roller 25. The paper P may be fed to the conveying unit 21 while being guided by guides 27*b* and 27, and being pinched by a pair of rollers 26. The pickup roller 25, and the guide 27*b*, which is located nearest to the paper feed cassette 1*b*, may be affixed to the paper feed cassette 1*b*.

The conveying unit 21 may comprise a plurality of, e.g., two, belt rollers 6 and 7, an endless conveying belt 8 that is looped over the belt rollers 6 and 7, and a tension roller 9. The tension roller may apply a tension to the conveying belt 8 by urging downward the conveying belt 8 in the lower-side loop thereof while making contact with an inner peripheral surface of the conveying belt 8. The belt roller 7 may be a drive roller. Also, the belt roller 7 may be given a driving force by a conveying motor fixed to a shaft 7*x* of the belt roller 7, to thereby rotate in the clockwise direction in FIG. 2. The belt roller 6 may be a driven roller. Also, The belt roller 6 may rotate in the clockwise direction in FIG. 2 as a result of traveling of the conveying belt under rotation of the belt roller 7. The tension roller 9 may be positioned nearer to the belt roller 7 on the drive side than the belt roller 6 on the driven side.

The belt roller 6 on the driven side may be configured to be movable downward to the area B. That is, the area B may be an area for accommodating the paper feed cassette 1*b* as well as an area in which a portion of the conveying unit 21 may be positioned by the downward movement of the belt roller 6.

The outer peripheral surface of the conveying belt 8 may have stickiness by being subjected to silicone treatment. A nip roller 4 may be positioned across the conveying belt 8 from the belt roller 6 on the paper conveying path. The nip roller 4 may press down the paper P fed from the paper feed cassette 1*b*, on the outer peripheral surface of the conveying belt 8. The paper P pressed down on the outer peripheral surface of the conveying belt 8 may be conveyed rightward while being held on the outer peripheral surface by an adhesive force of the outer peripheral surface. Moreover, a release plate 5 may be positioned across the conveying belt 8 from the belt roller 7 on the paper conveying path. The release plate 5 may release the paper P held on the outer peripheral surface of the conveying belt 8 from the outer peripheral surface. The paper P released from the outer peripheral surface of the conveying belt 8 by the release plate 5 may be conveyed upward while being guided by a guide 29. The paper p may be pinched by the pair of rollers 28, and discharged from an opening 30 formed at an upper part of the casing 1*a*, to the paper discharge portion 31.

The plurality of, e.g., four, ink jet heads 2 each may extend along a main scanning direction, i.e., direction perpendicular to the plane of FIG. 2. The plurality of ink jet heads 2 may be positioned side by side in an auxiliary scanning direction, i.e., direction perpendicular to the main scanning direction, and lateral direction in FIG. 2. The plurality of ink jet heads may be supported by the casing 1*a* via a frame 3. That is, the ink jet printer 1 may be a line type color ink jet printer having an ejection region extending in the main scanning direction. A bottom surface of each of the ink jet heads may constitute an ink ejection surface 2*a* having the ejection region extending in the main scanning direction.

A platen 19 having a substantially rectangular parallelepiped shape may be positioned oppositely to the plurality of ink jet heads 2 inside the loop of the conveying belt 8. A top surface of the platen 19 may be in contact with the inner peripheral surface of the upper-side loop of the conveying belt 8. The top surface thereof may support the upper-side loop of the conveying belt 8 on the inner peripheral side thereof. As a result, the outer peripheral surface of the upper-side loop of the conveying belt 8 and the bottom surfaces of the ink jet heads 2, i.e., ejection surfaces 2*a* may become oppositely parallel to each other. Also, a slight gap may be formed between the ejection surfaces 2*a* and the outer peripheral surface of the conveying belt 8. This gap may constitute a part of the paper conveying path. When sheets of the paper P that have been conveyed while being held on the outer peripheral surface of the conveying belt 8 pass directly under the plurality of ink jet heads 2 one after another, inks of some of the colors may be ejected onto the sheets of the paper, whereby a desired image may be formed on each of the sheets of the paper P.

The ink jet heads 2 may be connected to respective ink tanks 50 in the ink tank cassette 1*c* mounted in the space C. That is, inks having colors of their respective ink jet heads 2 may be stored in the plurality of, e.g., four, ink tanks 50, and may be supplied from the ink tanks 50 to the respective ink jet heads 2 via tubes. The ink tank 50 may be replaceable by demounting/mounting the ink tank cassette 1*c*.

Figure 3A:
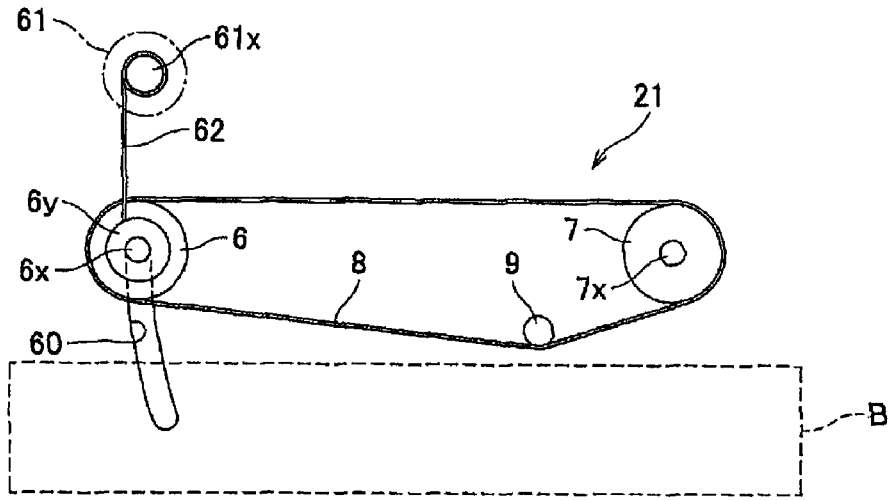
FIGS. 3A and 3B are schematic views each showing a movement of a belt roller.
Figure 3B:
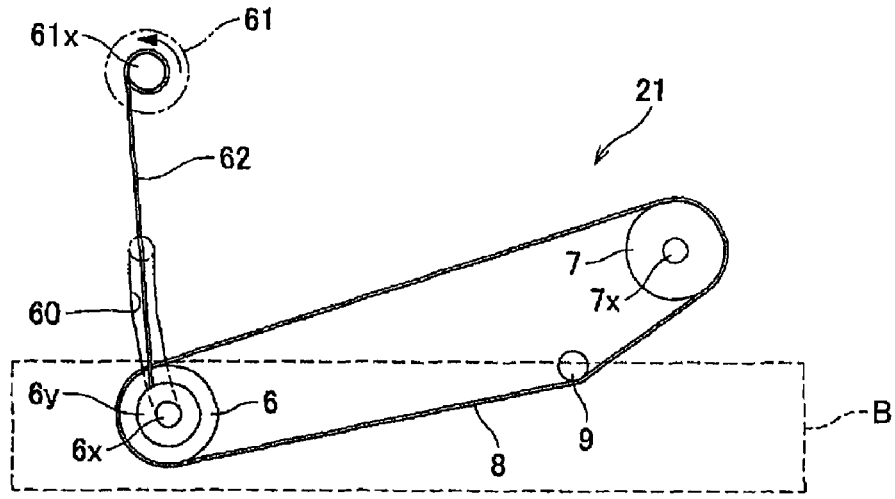

Referring to FIGS. 3A and 3B, shafts 6*x* may be fixed to both axial ends of the belt roller 6, so as to protrude from the both ends in the axial direction. Each of the shafts 6*x* may be extend through a slit 60 formed in the printer body. The slit 60 may be an elongated hole with a position of the shaft during normal printing shown in FIG. 2 as an upper end, and with a position that extends from the upper end diagonally downward to the right while describing an arc about the shaft 7*x* of the belt roller 7. A lower end may be positioned at the end of slit 60 that extends into area B. FIGS. 3A and 3B each show how the shaft 6*x* positioned on one end of the belt roller 6 may be moved to different positions, e.g., between a first position and a second position, through the slit 60. A level difference portion 6*y* having larger diameter than the shaft 6*x* may be positioned between one end of the belt roller 6 and the shaft 6*x*. One end, e.g. first end, of the connection member 62, such as a wire, may be fixed to the shaft 61*x* of the turning member 61 while being wound therearound. The other end, e.g. second end, of the connection member 62 may be fixed to the side surface of the above-described level difference portion 6*y* of the belt roller 6. Referring to FIG. 3A, the shaft 61*x* of the turning member 61 may be given a load in the clockwise direction by a gear or a clutch spring in order to prevent the connection member 62 from being wound off, in a state during normal printing.

During jamming processing for the paper P, the user of the ink jet printer 1 may firstly remove the paper feed cassette 1*b* to the front side of the plane of FIG. 1 to separate it from the casing 1*a*. Thus, the area B may enter a state of not accommodating paper feed cassette 1B.

Thereafter, as the user operates the turning member 61 and turns it in the counterclockwise direction in FIG. 3A, the connection member 62 may be wound off from the shaft 61*x*. As a result, referring to FIG. 3B, the distance between the shaft 61*x* and the level difference portion 6*y* between which the connection member 62 are connected may increase; the shaft 6*x* may move diagonally downward to the right describing an arc about the shaft 7*x* of the belt roller 7 while sliding along the slit 60; and the shaft 6*x* may stop at the lower end of the slit 60 located a position corresponding to the area B, e.g., the second position. Along with such a movement of the shaft 6*x*, the belt roller 6 may also move diagonally downward to the right describing an arc about the shaft 7*x* of the belt roller 7, and one part of the conveying unit 21, that is, a part of the belt roller 6 and a part of the conveying belt 8 may be positioned at the area B. At this time, the one part of the conveying unit may be positioned in the area B, and the conveying unit 21 may be located within the area A and the area B. Although the belt roller 7 may be located at a fixed position, the tension roller 9 may arcuately swing about the shaft 7*x* of the belt roller 7 during movement of the belt roller 6, such that tension with respect to the conveying belt 8 is kept constant and the shape of the conveying belt 8 is kept substantially constant. The shaft 61*x* of the turning member 61 may be given a load in the clockwise direction by, e.g., a gear or a clutch spring, in order to prevent the moving speed of the belt roller 6 from becoming too high during the movement of the belt roller 6.

The distance between the conveying belt 8 and the ink jet heads 2 may increase by moving the belt roller 6 from the position shown in FIG. 3A, e.g., first position, to that shown in FIG. 3B, e.g., second position. Therefore, it may be possible to check the paper P that has jammed between the upper-side loop of the conveying belt 8 and the ink jet heads 2 in the course of being conveyed. The paper p may be removed from the casing 1*a*, by pulling door 1*d* positioned on the front side of the casing 1*a* toward the user's side to thereby open the door 1*d*.

After the jamming processing has been performed in this way, the opened door 1*d* may be closed, and the turning member 61 may be turned in the clockwise direction in FIG. 3B. As a consequence, the connection member 62 may be rewound by the shaft 61*x*; the distance between the shaft 61*x* and the level difference portion 6*y* between which the connection member 62 are connected may decrease. The shaft 6*x* may move diagonally upward to the left describing an arc about the shaft 7*x* of the belt roller 7, while sliding along the slit 60. The shaft 6*x* may stop at the upper end of the slit 60 shown in FIG. 3A. Along with such a movement of the shaft 6*x*, the belt roller 6 may also move diagonally upward to the left describing an arc about the shaft 7*x* of the belt roller 7. The belt roller 6 may return to the original position shown in FIG. 3A, that is, to the position during normal printing, e.g., first position. Thereafter, the paper feed cassette 1*b* may be remounted to the casing 1*a* and placed within the area B. Thus, the ink jet printer 1 may reenter a state of being capable of printing. For example, upon receipt of a print restart instruction from personal computer (PC) or the like, the ink jet printer 1 may feed the paper P lying in the uppermost position within the paper feed cassette 1*b* and may perform printing.

According to the above-described embodiment, when moving the conveying unit 21 during jamming processing, the use of accommodation area B in the paper feed cassette 1*b* may eliminate the need for a space exclusively for moving the conveying unit 21.

In an embodiment of the invention, the openable and closable door may be positioned in the front of the casing 1*a*. The openable and closable door may oppose the conveying belt 8 in the direction parallel with the outer peripheral surface of the conveying belt 8 and perpendicular to the conveying direction, that is, in the direction perpendicular to the plane of FIG. 2. Therefore, the opening of the door during jamming processing for the paper P may facilitate checking of the paper P in the course of being conveyed on the outer peripheral surface of the conveying belt 8, and may further facilitate taking-out work of the paper P.

When the mounting and demounting and the opening and closing are performed from the same direction, e.g., from the front side of the casing 1*a* as in this embodiment, it may suffice to secure a space in the pertinent direction alone, which may lead to an improvement in versatility of installation. Referring back to FIG. 1, the surface on which the door is not provided may be positioned adjacent to, e.g., the wall W1 or W2, or another body 600.

Referring to FIG. 3B, when the belt roller 6 on the driven side is moved, with the belt roller 7 on the drive side fixed, there may be no need to move the conveying motor, which may allow the movement mechanism to be simplified in construction.

In the above-described embodiment, because the tension roller 9 may be positioned nearer to the belt roller 7 than the belt roller 6, the movement of the belt roller 6 may not be hindered by the tension roller 9 when the belt roller 6 is moved to the area B.

In the above-described embodiment, during jamming processing, the belt roller 6 may be moved by a user's operation. In another embodiment of the invention, under control by a controller of the printer 1, the movement of the belt roller 6 may be realized automatically. For example, in another embodiment, the printer 1 may comprise a sensor for detecting jamming of the paper P, a sensor for detecting mounting, demounting, or both, of the paper feed cassette 1*b*, and a motor driving the turning member 61. Firstly, the controller may notify the user of an occurrence of jamming and an instruction to remove the paper feed cassette 1*b*, based on jamming detection by the sensor. When the paper feed cassette 1*b* has been removed by the user, the controller may control the motor to move the belt roller 6 to the accommodation area B for the paper feed cassette 1*b*, based on the detection of the separation of the paper feed cassette 1*b*. After the belt roller 6 has been moved, the controller may notify the user of an instruction to remove the paper P. The user who has ascertained the notification opens the door 1*d*, and after having taken out jammed paper P from the casing 1*a*, may close the door 1*d*. Thereupon, on the basis of detection of the jamming processing completion and that of the closing of the door 1*d*, the controller may control the motor to return the belt roller 6 to the original position. Then, the controller may notify the user of an instruction to mount the paper feed cassette 1*b*. When the paper feed cassette 1*b* may be remounted into the casing 1*a*, the controller may restart printing on the basis of the sensor's mounting detection of the paper feed cassette 1*b*.

The turning member 61 is not limited to being extended through the surface on which the door 1*d* in the casing 1*a*.

The tension roller 9 is not limited to being disposed at nearer to the belt roller 7 than the belt roller 6. The tension roller 9 may be positioned at another position.

In the above-described embodiment, although the belt roller 6 on the driven side is moved, with the belt roller 7 on the drive side fixed, the invention is not limited to this method. For example, the belt roller 7 may be moved, with the belt roller 6 fixed. Alternatively, the belt rollers 6 and 7 may be simultaneously lowered to thereby translate the overall conveying unit 21.

In the above-described embodiment, because the pickup roller 25 and the guide 27*b* may be mounted to the paper feed cassette 1*b*, these elements may be separated from the casing 1*a* simultaneously with removal of the paper feed cassette 1*b*. When these elements are mounted to the casing 1*a*, these elements may be retracted from the area B prior to the removal of the paper feed cassette.

The door 1*d* is not limited to being positioned on the side in which the area B is opened. For example, the door 1*d* may be positioned on the right or left side surface of the casing 1*a*. Although the door 1*d* of the above-described embodiment may be opened and closed with the horizontal axis on the bottom edge as a fulcrum, the invention is not limited thereto. For example, the door 1*d* may be opened and closed with a horizontal axis on a top edge as a fulcrum, may be laterally opened and closed, or may be opened and closed in other various manners.

In the above-described embodiment, during jamming processing, not only the paper feed cassette 1*b* but also the ink tank cassette 1*c* may be removed from the casing 1*a*, to thereby move the belt roller 6 to the area C. Moreover, the ink tank cassette 1*c* may be omitted.

During jamming processing, the accommodation area B for the paper feed cassette 1*b* may be used as the area of movement destination of the conveying unit 21, in the above-described embodiment. However, accommodation areas for various elements other than the paper feed cassette 1*b*, such as the ink tank cassette or a duplex conveying unit, may be utilized.

Figure 4:
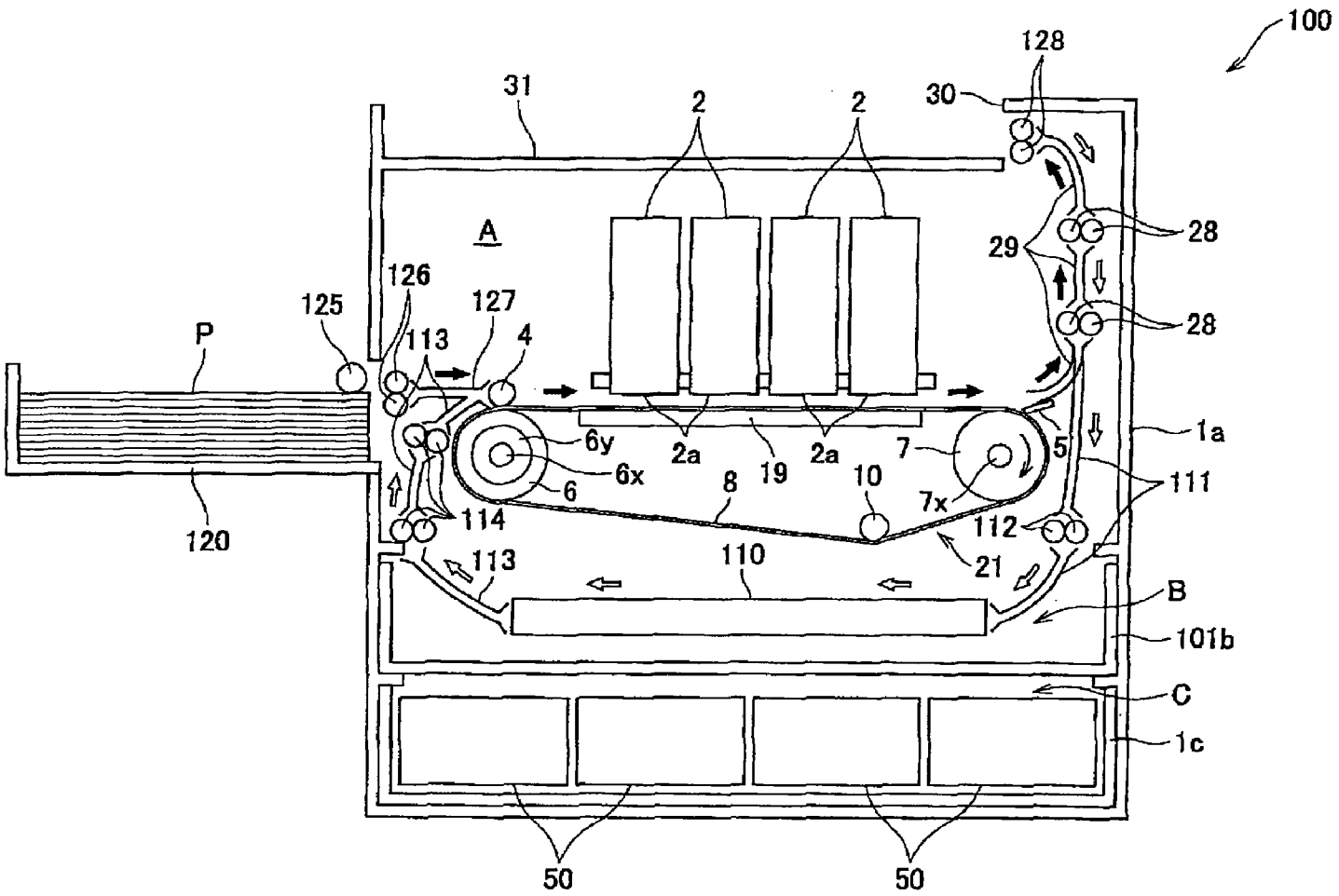
FIG. 4 is a sectional side view of the ink jet printer according to another embodiment.

For example, referring to FIG. 4, in another embodiment of the invention, a duplex conveying cassette 101*b* may be accommodated in the area B instead of the paper feed cassette 1*b*. In this embodiment, the same elements as the foregoing are designated by the same symbols, and description thereof is omitted. The duplex conveying cassette 101*b* may be removably mounted with respect to the casing 1*a*, and may comprise a duplex conveying unit 110. That is, the ink jet printer 100 according to this embodiment may be capable of duplex printing.

A tray 120 may be positioned in the left side surface of the casing 1*a*. Sheets of the paper P that are stacked within the tray 120 may be fed from an uppermost sheet one after another by a pickup roller 125. The each sheet of the paper P may be fed to the conveying unit 21 while being pinched by a pair of rollers 126 and being guided by a guide 127 along a thick arrow in FIG. 4.

Then, after each sheet of the paper P has been subjected to printing on its surface, while passing under the ink jet heads 2, it may be conveyed upward. The paper P that has been conveyed upward may be reversed in conveying direction by a pair of forward and backward feed rollers 128 positioned in the vicinity of an opening 30, and may be conveyed downward in the reverse direction along hollow arrows in FIG. 4.

Then, the paper P may be conveyed to the duplex conveying unit 110 including a skew correction roller while being guided by a guide 111 and being pinched by a pair of rollers 112. The paper P that has been conveyed while being subjected to skew correction in the duplex conveying unit 110 may be again fed to the conveying unit 21 while being guided by a guide 113 and being pinched by a pair of rollers 114. At this time, the paper P may be in a state of having been turned upside down, that is, it may be placed face down.

By passing under heads in this state, the paper P may be subjected to printing on the back surface thereof. In this way, after the paper P has undergone printing on both of the surface and the back surface, it may be again fed upward along the thick arrows in FIG. 4, and may be discharged to the paper discharge portion 31. During jamming processing for the paper P, the duplex conveying cassette 101*b* may be removed as in the case of the above-described paper feed cassette 1*b*, and separated from the casing 1*a*.

The area B serving as a movement destination of the conveying unit 21 during jamming processing is not limited to being positioned on an opposite side of the conveying unit 21 from the ink jet head 2.

The recording device according to the invention is not limited to the ink jet type, and may be applied to a thermal type. Moreover, the recording device according to the invention is not limited to the line type, and applicable to a serial type in which heads reciprocate. Furthermore, the recording device according to the invention is not limited to the printer, and applicable to a facsimile, a copier, and the like.

It will be appreciated by those of ordinary skill in the relevant art that various modifications may be made without departing from the scope of the invention. Accordingly, the embodiments disclosed herein are exemplary. It is to be understood that the scope of the invention is not to be limited thereby, but is to be determined by the claims which follow.

What is claimed is:

1. A recording device comprising:

a casing comprising a first area and a second area provided therein;

a conveying unit that is configured to convey a recording medium, wherein the conveying unit is positioned in the first area of the casing;

a recording unit that is configured to perform recording on the recording medium that is being conveyed by the conveying unit, the recording unit opposing the conveying unit in the casing;

a cassette that is configured to be removably mounted to the casing in the second area of the casing; and a movement mechanism that is positioned in the first area on an opposite side of the conveying unit from the second area and that is configured to move at least one portion of the conveying unit into the second area of the casing.

2. The recording device according to claim 1, wherein when at least the portion of the cassette is removed from the casing, the entire cassette is separated from the casing.

3. The recording device according to claim 1, wherein the recording unit is positioned in the first area.

4. The recording device according to claim 3, wherein the first area, the conveying unit, and the second area are arranged in descending order from a top of the casing.

5. The recording device according to claim 1, wherein the conveying unit comprises a conveying member configured to convey the recording medium along a conveying direction on a surface of the conveying member; and wherein the casing comprises a door that opposes the conveying member in a direction parallel with the surface of the conveying member and perpendicular to the conveying direction.

6. The recording device according to claim 5, wherein the door is positioned on a side of the casing through which at least the portion of the cassette is removed.

7. The recording device according to claim 1, wherein the conveying unit comprises:

a drive roller;

a driven roller driven by the drive roller; and a belt that is looped over the drive roller and the driven roller therebetween and that is configured to convey the recording medium placed on a surface thereof; and wherein the movement mechanism is configured to move the driven roller to the second area.

8. The recording device according to claim 7, wherein position of the drive roller is fixed.

9. The recording device according to claim 7, wherein the conveying unit further comprises a tension roller that is positioned nearer to the drive roller than the driven roller, and that is configured to apply a tension to the belt while being in contact with a inside surface of the belt.

10. The recording device according to claim 9, wherein the driven roller is configured to move from the first position to the second position by the connection member being wound off from the turning member as a result of backward turning of the turning member, and the driven roller is configured to return from the second position to the first position by the connection member being rolled up by the turning member as a result of forward turning of the turning member.

11. The recording device according to claim 7, wherein the movement mechanism comprises:

a turning member configured to be turned; and a connection member comprising a first end which is fixed to the turning member, and a second end which is connected to the driven roller; and wherein the driven roller configured to move between a first position and a second position, wherein the first position is positioned at an original position at which the driven roller is configured to be driven, and the second position is positioned within the second area.

12. The recording device according to claim 11, wherein the turning member extends through a surface on which the door in the casing is placed.

13. The recording device according to claim 1, wherein the movement mechanism is further configured to be turned via a portion of the movement mechanism extending from an outside of the casing.

14. The recording device according to claim 1, wherein the movement mechanism is further configured to be driven by a motor.

15. A recording device comprising:

a casing having a first area and a second area provided therein;

a conveying unit that is configured to convey a recording medium, wherein the conveying unit is positioned in the casing between the first area and the second area of the casing;

a recording unit that is configured to perform recording on the recording medium that is being conveyed by the conveying unit, the recording unit opposing the conveying unit in the casing;

a cassette that is configured to move between a first position and a second position, wherein the cassette is mounted in the second area of the casing in the first position and at least a portion of the cassette is removed from the second area of the casing in the second position; and a movement mechanism that is positioned in the first area of the casing and that is configured to move at least one portion of the conveying unit to the second area of the casing.

* * * * *